United States Patent [19]

Weyer

[11] 3,952,714

[45] Apr. 27, 1976

[54] LINK LENGTH ADJUSTING APPARATUS

[75] Inventor: Herbert Weyer, Stuttgart, Germany

[73] Assignee: Robert Bosch GmbH, Stuttgart, Germany

[22] Filed: Mar. 14, 1974

[21] Appl. No.: 451,374

Related U.S. Application Data

[63] Continuation of Ser. No. 266,752, June 27, 1972, abandoned.

[30] Foreign Application Priority Data

July 5, 1971 Germany ..... 2133244

[52] U.S. Cl. ..... 123/103 C; 123/98; 123/140 R

[51] Int. Cl.[2] ..... F02D 31/00; F02D 11/02

[58] Field of Search ..... 123/103 C, 97 R, 98, 123/104 R, 140 R, 103 C; 92/465, 117, 131; 74/857, 858; 192/.08, .084, .082, .062

[56] References Cited

UNITED STATES PATENTS

| | | | |
|---|---|---|---|
| 1,996,679 | 4/1935 | Leper | 123/104 X |
| 2,529,437 | 11/1950 | Weinberger | 123/103 C |
| 2,637,341 | 5/1953 | Borst | 92/131 X |
| 2,732,048 | 1/1956 | Porster et al. | 192/.08 |
| 2,739,678 | 3/1956 | Parker | 192/.08 |

*Primary Examiner*—Wendell E. Burns
*Attorney, Agent, or Firm*—Michael J. Striker

[57] ABSTRACT

Control apparatus has a double-acting hydraulic cylinder and a piston reciprocable in the cylinder in response to application of suitable hydraulic pressures to the piston. The ends of the cylinder are connected to a source of hydraulic pressure by means of two-position valves. The piston is connected to one rod and the cylinder to another rod — the two rods forming part of a linkage between a gas pedal and a fuel injection pump. An electronic apparatus controls the valves to change the overall length between the outer ends of the rods to change the effective length of the linkage and to control the fuel injection pump.

7 Claims, 2 Drawing Figures

LINK LENGTH ADJUSTING APPARATUS

This is a continuation of application Ser. No. 266,752 filed June 27, 1972 now abandoned.

BACKGROUND OF THE INVENTION:

The present invention relates to fuel regulation devices for internal combustion engines, and particularly to a device for regulating the quantity of gasoline provided to an internal combustion engine prior to shifting of the transmission of the engine — the device being located in the linkages connecting the gas pedal and the fuel injection pump.

With motor vehicles having gear transmissions it is known that it is necessary to briefly decrease the speed of the engine when upshifting or shifting from a lower to a higher gear. This is desirable and, in fact, usually necessary so that the speed of the driving gears as well as the driven gears are brought to approximately the same angular velocities prior to meshing or engagement of these gears without undue grinding or clashing. Similarly, by shifting down of the transmission from a higher to a lower gear, the speed of the engine must normally be temporarily increased. Thus, with a non-synchronized transmission, it is possible, only during downshifting to momentarily increase the speed of the engine by so-called "intermittent gas feeding". When upshifting, in order to protect the clutch as well as to effect shorter gear switching times, it is necessary to decrease the speed of the engine by releasing the gas pedal. In synchronized engines the intermittent gas feeding as well as the gas pedal release are usually not necessary during shifting gears, however, these transmissions are costlier than the non-synchronized transmissions.

SUMMARY OF THE INVENTION:

Accordingly, it is an object of the present invention to provide a control apparatus for use with non-synchronized transmissions which alleviates some of the disadvantages in the operation of these transmissions.

It is another object of the present invention to provide a control apparatus which is simple in construction and economical to manufacture and which permits the utilization of non-synchronized transmissions, while obtaining some of the simplicity of operation known with synchronized transmissions.

It is still another object of the present invention to provide a device for use with transmissions during shifting of gears which influences the speed of internal combustion engines.

It is a further object of the present invention to provide a control apparatus which changes the effective length of the gas control linkages to thereby change the amount of fuel provided to the internal combustion engine without actuation of the gas pedal.

According to the present invention, the control apparatus for regulating the quantity of fuel delivered to an internal combustion engine comprises fuel injection means having fuel adjusting means movable between two end positions for changing the quantity of fuel injected into the engine. Movable actuating means are provided, and linkage means which have a predetermined length between said actuating means and said fuel adjusting means for transmitting the movement of the former to the latter. Linkage adjusting means are provided for changing the length of said linkage means to thereby change the position of said fuel adjusting means in dependence on the operating condition of the engine.

According to a presently preferred embodiment, said linkage adjusting means comprises double-acting hydraulic cylinder and piston means having an extensible rod means whose length can be adjusted by the actuation of a pair of two position valves. By activating one or the other or both of the valves, the effective length of the control rod means may be modified — this affecting the effective length of the entire linkage associated with the fuel system. The valves are actuated in response to different operating conditions of the internal combustion engine. With the construction in accordance with the present invention, the stopping and accelerating of the internal combustion engine during transmission gear changing are greatly simplified — this replacing the manual gas pedal operations presently required for changing gears of a non-synchronized transmission. The apparatus is particularly suitable in connection with truck transmissions which are partly automatically actuated.

A particularly compact construction results when the apparatus in accordance with the invention comprises a hydraulic cylinder, and a piston which is reciprocable therein and which is maintained in a substantially central position by means of springs which bias the piston on each side thereof. The position of the piston is controlled by the application of hydraulic fluid under pressure to one or the other side of the piston — this being accomplished by actuating one, another or both magnetic valves which control passage of pressure fluid to either side of the piston. An electronic control apparatus controls the condition of the valves and forms part of the shifting apparatus.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figures 1, 2:
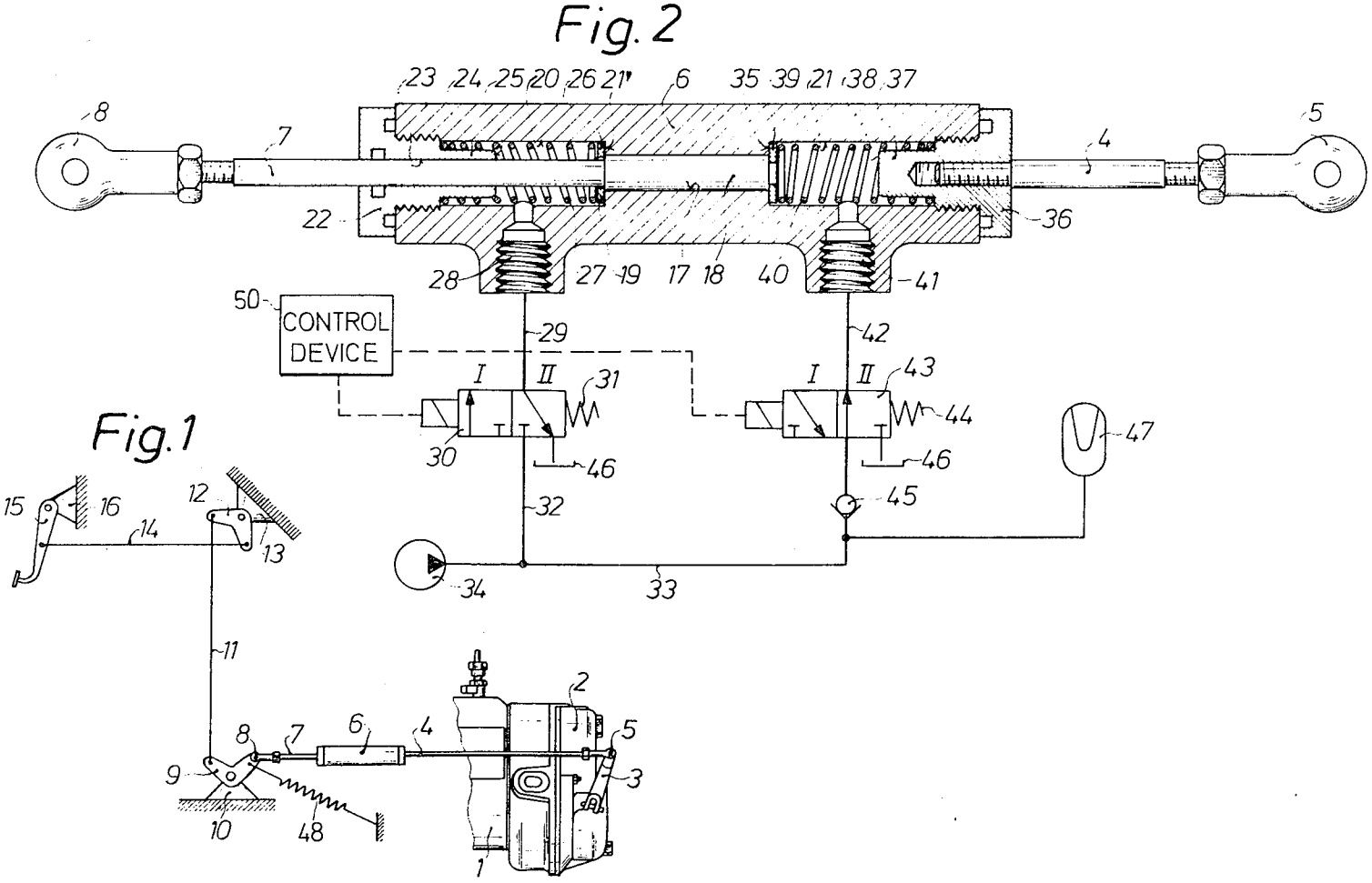
FIG. 1 is a simplified representation of a fuel control system of an internal combustion engine.
FIG. 2 is a longitudinal cross section through a hydraulic cylinder in accordance with the present invention, which is adapted to be inserted in the linkage lines of the fuel system shown in FIG. 1.

DESCRIPTION OF THE PREFERRED EMBODIMENT:

A part of a fuel injection pump 1 is designated by reference numeral 1. The fuel injection pump is of the type utilized for fuel injection systems in Diesel motors which are normally utilized in trucks or other vehicles utilizing non-synchronized or partly automatic transmissions. The injection pump 1 has a mechanical regulator 2 which regulates the amount of fuel which is to be provided to the internal combustion engine. A positioning lever 3, associated with the mechanical regulator 2, is pivotally mounted on the injection pump 1 and turns about its pivot point between two angular end positions to regulate the amount of fuel which is delivered by the mechanical regulator 2. The operation of the mechanical regulator 2 and the positioning lever 3 is known and does not itself form part of the invention. However, to describe the subject matter of the invention, it will be understood that the mechanical regulator is so constructed that the positioning lever 3 rotates in the plane of the drawing between the two end positions. A first position, when the positioning lever 3 has turned to its furthermost clockwise position represents that setting of the mechanical regulator where little or no fuel is delivered to the injection pump 1 and represents the "stop" position of the internal combustion engine. On the other hand, the other end position, when the positioning lever 3 has turned to its maximum counterclockwise position, represents the "full load" or "full acceleration" position of the injection pump 1. The free end of the positioning lever 3 is pivotally connected to a rod 4, e.g., by means of a ball and socket joint 5 or other suitable pivoting connector means. The rod 4 is connected to a hydraulic cylinder 6, which forms the subject invention, and will be further described in connection with FIG. 2. While the rod 4 is fixed relative to the hydraulic cylinder 6, a piston rod 7 is slidably mounted in the hydraulic cylinder 6 and is arranged for axial movement relative to the latter. The free end of the piston rod 7 is connected by means of a ball joint or ball and socket joint 8 to a bell crank or two-arm lever 9, the latter being pivotally mounted at an intermediate point about a fixed member 10. The bell crank 9 is connected by a rod 11 to the bell crank 12, the latter being pivotally mounted on a fixed member 13. A rod 14 connects the bell crank 12 and a gas pedal 15. The gas pedal 15 is also pivotally mounted on a fixed member 16. The members 9, 11, 12 and 14 together comprise a fuel linkage system which, together with the hydraulic cylinder 6, are used to selectively position the positioning lever 3 in dependence on the desired acceleration by the driver during normal operation of the vehicle or by the requirements for gear changes in the transmission. It will be noted, that depression of the gas pedal 15, i.e. turning of the gas pedal counterclockwise about its mounting pivot point, causes the positioning lever 3 to rotate in a counterclockwise direction about its pivot point, against the action of a restoring spring 48, so that the mechanical regulator 2 increases the amount of fuel injected into the engine. On the other hand, release of the gas pedal 15 causes the positioning lever 13, partly due to the restoring springs 48, to return in a clockwise direction towards the "stop" position of the positioning lever. As to be described below, the distance between the ball and socket joints 5 and 8, is maintained substantially constant during normal operation of the vehicle. Thus, the gas pedal 15 controls the angular position of the positioning lever 3 so that the driver controls the speed of the vehicle thereby. However, when switching gears of the transmission is about to take place, the hydraulic cylinder 6 changes the distance between the points 5 and 8 to thereby decrease the speed of the engine momentarily when upshifting or to momentarily increase the speed of the engine when downshifting of the transmission, as was previously required to be done by the driver manually.

The hydraulic cylinder 6, shown in greater detail in FIG. 2, has a longitudinal bore or passage having two ends. The longitudinal passage has a central passage portion 17 which has an inside diameter substantially equal to the outer diameter of a piston 18 which is arranged for reciprocation in the passage. The piston 18 is connected to the piston rod 7 so that the latter shares the axial movements of the former. The piston rod 7 has a smaller diameter than the diameter of the piston 18 so an annular surface or shoulder 19 is formed at the junction of the piston 18 and rod 7. The passage through the cylinder has to opposite sides of the passage portion 17 a pair of passage portions 20 and 21 having each a greater inner diameter than that of the passage portion 17. The passage portion 20 forms with the longitudinal passage portion 17 a shoulder 21' and is closed at one end by a cover 22 threadingly connected to the cylinder 6. The piston 7 is slidably mounted in a bore 23 in the cover 22 and has an outer diameter which corresponds to the inner diameter of the bore 23. The cover 22 is provided with an extension 24 whose front side forms a bearing surface 25 adapted to engage a spring cap or washer 2G when the latter has moved towards the left, as viewed in FIG. 2, to the extreme end position. A spring 27 is provided in the passage 20 and is maintained in a compressed state between the cover 22 and the washer 26. The washer 26 presses against the shoulder 21' of the cylinder 6 as well as against the annular shoulder 19 of the piston 18 in the normally central position of the latter. In effect, the spring 27 has the tendency of urging the piston 18 towards the right and is the least stressed when the annular shoulder 19 of the piston 18 coincides with the shoulder 21'.

The axial length of the piston 18 is made equal to the length of the longitudinal passage 17 — the passage 17 being provided in the center of the hydraulic cylinder 6. A passage 28 in the form of a conduit, communicates with the passage 20 while a conduit 29 is connected to the passage 28 and is in fluid communication with the latter. Connected with the conduit 29 is an electromagnetic valve 30 which has three ports and two positions. The two positions are represented by the reference designations I and II. The magnetic valve 30 is arranged so that under its normally unexcited or unenergized state, it rests in the position II as a result of a spring 31 which biases it into that position. Also connected to the magnetic valve 30 is a conduit 32 which is in fluid communication with a supply conduit 33, the latter being supplied by a pump 34.

Now examining the other side of the hydraulic cylinder 6, a longitudinal passage portion 21 which forms an extension of the passage portion 17 but with a greater inside diameter, similarly to that of passage portion 20, so as to form a shoulder 35 at the junction of the two passage portions and is closed by a cover 36. A rod 4 is fixedly connected to the cover 36, e.g. by screwing the former into the latter. The cover 36 is provided with an extension 37 whose front side acts as a bearing surface 38 for a spring cap or washer 39 which is normally maintained by a spring 40 against the shoulder 35 of the passage 21. When the piston 18 moves toward the right, as viewed in FIG. 2, the washer 39 prevents further movement of the piston 18 towards the right once the washer 39 has engaged the bearing surface 38. The springs 27 and 40 are so selected so that in the normal or steady state condition, the piston 18 is maintained in the middle or central position of the housing 6 — with the piston 18 being wholly contained within the passage 17 and with both springs 27 and 40 being maximally expanded.

Into the passage portion 21 empties a passage 41, the end of the latter forming an inlet and is shown provided with a thread. A conduit 42, shown in schematic, is connected to the inlet of the passage 41, said conduit also being connected to an electromagnetic valve 43 similar to the valve 30. Thus, the valve 43 is provided with three parts and is a two-position valve. The respective positions of the valve are designated by the reference designations I and II. In the case of the magnetic valve 43, as with the valve 30, its normal or steady state unexcited position is position II — this position being maintained by a spring 44. Connected to the magnetic valve 43 is a supply conduit 33 provided with a non-return or check valve 45. The non-return valve is so arranged so that it opens in the direction of the magnetic valve 43 but prevents the return flow of fluid from the valve back into the supply conduit 33. Both magnetic valves have a port which is connected to a reservoir 46. A pressure reservoir 47 is connected to the supply conduit 33 between the pump 34 and the non-return valve 45. The pressure reservoir 47 includes means for generating a pressure while the pump 34 is on — so that said reservoir may apply a pressure in the supply conduit 33 for a time after the pump 34 had been deactivated or deenergized. It is noted that the magnetic valves 30 and 43 are identical except that the valve 30, in the position I, connects the conduit 29 with the conduit 32 whereas the connection to the reservoir 46 is closed. In position 11 of the valve 30, the conduit 29 is connected to the reservoir 36 whereas the connection to the conduit 32 is closed. The reverse is true for the valve 43 so that in position I of the latter, the conduit 42 is connected to the reservoir 46, whereas the connection to the conduit 33 via the non-return valve 45 is closed. Similarly, with the valve 43 in position II, the conduit 42 is connected to the supply conduit 33 via the non-return valve 45, whereas the connection to the reservoir 46 is closed.

The operation of the apparatus will now be described. When neither of magnetic valves 30 and 43 is excited, the springs 31 and 44 cause both of these valves to assume the position II. As described above, this means that the magnetic valve 43 is open or that hydraulic fluid may flow from the supply conduit 33 to the conduit 42. On the other hand, the magnetic valve 30 is blocked or closed and hydraulic fluid may not flow from the conduit 32 to the conduit 29 — the conduit 29 only being connected with the reservoir 46. Under these conditions, with the pump 34 in operation, pressure medium or hydraulic fluid flows through the conduit 33 and into the passage 21 via the non-return valve 45 and conduit 42. With pressure built up in the passage 21, the piston 18 moves towards the left, as seen in FIG. 2, against the biasing action of the spring 27 until the washer 26, which travels with the piston 18, abuts against the bearing surface 25. This movement of the piston 18 towards the left causes the rod 7 to be further extended toward the outside of the cylinder 6. Referring to both FIGS. 1 and 2, it is noted that with the joint 5 fixed relative to the cylinder 6, such extension of the piston rod 7 causes the distance between the joints 5 and 8 to increase and, as described above, to cause the positioning lever 3 to turn in a clockwise direction to a stop position of the engine. Once the fluid has flowed into the passage 21, it maintains the piston 18 in the leftmost position because of the action of the non-return valve 45 which prevents flow of fluid from the passage 21 back into the supply conduit 33. Thus, although the pressure in the supply conduit 33 may drop, once the stop position of the positioning lever 3 has been achieved, the amount of fuel supplied by the mechanical regulator 2 may be selected and maintained at any low desirable value. If the position of the positioning lever 3 is selected so that the engine keeps running but at very low rpm to thereby prevent moving of the vehicle, the non-return valve 45 insures that the quantity of fuel delivered to the engine does not increase with time whereby the engine may pick up speed and moving may start.

To accelerate the motor, both the magnetic valves 30 and 43 are excited, wherein they are brought both to their position I. Now, the roles are reversed and fluid may flow from the supply conduit 33 through the conduits 32 and 29 into the passage 20 while fluid is prevented from flowing into the passage 21. Under these conditions, the pressure builds up in the passage 20 and the piston 18 is forced towards the right, as viewed in FIG. 2. Since the passage 21 is now connected to the reservoir 46, the pressure in the passage 21 may drop and, as the piston 18 moves towards the right, the hydraulic fluid in the passage 21 is forced to be discharged through the magnetic valve 43 and into the reservoir 46. The movement of the piston 18 towards the right takes place against the action of the spring 40 and, with increasing pressure in the passage 20, continues until the spring cap or washer 39 engages the bearing surface 38. Referring to FIGS. 1 and 2, the distance between the joints 5 and 8 becomes a minimum at this time. As described above, this causes the positioning lever 3 to turn in a counterclockwise direction until a full load or maximum fuel injection position is achieved. This corresponds to the start position.

To regulate the quantity of fuel delivered to the gasoline engine in a conventional manner, by actuation of the gas pedal 15, only magnet valve 43 is excited, so that both passages 20 and 21 are connected to the respective reservoirs 46. Under this condition, the springs 27 and 40 maintain the piston 18 in the central or middle position of the cylinder 6, as shown in FIG. 2, so that the actuation or movement of the gas pedals moves the positioning lever 3 while the distance between the joints 5 and 8 remains essentially constant. Thus, the springs 27, 40 transmit the movements of the linkages while maintaining the piston 18 within the passage 17. Accordingly, the springs must be sufficiently rigid to permit such transmission of forces for permitting responsive action. The valves 30 and 43 are actuated by an electronic apparatus 50 which is fully described in copending and commonly owned U.S. patent application, Ser. No. 162,339. As described in that application, the electronic apparatus 50 may cooperate with either the gas pedal or with a parameter of the vehicle, e.g. the velocity of the vehicle, or the position of a throttle valve in the intake manifold or the partial vacuum in the cylinders, to actuate the valves 30 and 43 prior to shifting of the transmission.

To increase the speed of the motor for changing the speed of the output shaft of the engine or changing gears of the transmission by "shifting down", both magnetic valves 30 and 43 are excited, as with the "start" condition described above. The distance between the two joints 5 and 8 is shortened, and the positioning lever 3 is turned fully counterclockwise regardless of whether the gas pedal 15 is pressed down or not pressed down to the full load position. The linkages, as well as the amount of lengthening or shortening of distances achievable between the joints 5 and 8, is so selected so that the full load or stop positions of the positioning lever 3 may be achieved by the actuation of the appropriate magnetic valves 30 and 43 regardless of the position of the gas pedal 15. By momentarily exciting both magnetic valves, the angular velocity of the output shaft of the engine is instantaneously increased to equalize the angular velocities of the latter with that of the input gears of the transmission. According to the presently preferred embodiment, the magnetic valve 30 is only maintained excited for several milliseconds. The momentary increase of fuel to the engine by the counterclockwise rotation or turning of the positioning lever 3, is sufficient to equalize the angular velocities of the transmission and the engine so as to assure smooth gear changing without damage to the gears themselves, this being equivalent to the intermittent pressing of the gas pedal which is performed manually as described above. After the several milliseconds have elapsed, the valve 30 is deenergized so that it reverts to its position II. However, the valve 43 remains excited and remains in position I. Thus, as described above, with the valve 30 in position II and the valve 43 in position I, both passages are made to communicate with their respective reservoirs 46 and the piston 18 is urged to its central position by the springs 27 and 40. Thus, after an initial increase in the speed of the engine, the gas pedal may now continue to regulate the positioning lever 3 and the hydraulic cylinder 6 effectively no longer influences the operation of the fuel system until the next gear shifting is required — the hydraulic cylinder 6 merely acting as a fixed link between the joints 5 and 8.

To decrease the speed of the motor such as for changing the speed of the transmission or shifting the gears by "shifting up", only the magnetic valve 30 is excited. Thus, with the magnetic valve 30 in the excited position I, and the valve 43 in the unexcited state, and therefore in the position II, both passages 20 and 21 are in communication with the supply conduit 33 and the pressure is applied to both sides of the piston 18. However, the free end of the piston 18, namely the right-hand side as viewed in FIG. 2, has a surface area which is greater than that of the annular surface 19 and there is formed a differential pressure on the piston 18 which causes it to move towards the left until the spring cap or washer 26 abuts against the bearing surface 25. Thus, the effect of exciting valve 30 without exciting valve 43 renders the same result as when both valves are left unexcited. As before, when the washer 26 abuts against the bearing surface 25, the positioning lever 3 turns fully clockwise as a result of the increase in length between the joints 5 and 8 to thereby bring the engine to its stop position. The speed of the motor is now decreased so that the angular velocity of the two coupling shafts which must be meshed in the higher gear are equalized. Here again, the speed of the engine is momentarily affected — in this case to momentarily decrease the speed of the engine. This momentary decrease in the amount of fuel delivered to the engine corresponds to the usual practice of the gas pedal being released manually prior to upshifting. After the gears have meshed, the gas pedal is permitted to resume control of the positioning lever 3. This is accomplished by denergizing originally energized valve 30 and energizing the originally not energized valve 43. Thus, after the lever 3 has been brought to the stop position for several milliseconds, the excitation to the valves 30 and 43 are reversed so that these valves are in their normal operating condition wherein the valve 30 is not energized and the valve 43 is energized. In this latter condition, as above, the piston 18 moves to its central position in response to the action of the biasing springs 27 and 40 and the gas pedal is permitted to assume control of the engine. The energization of the valves 30 and 43 as described above is regulated by the electronic apparatus 50 by means of a switching program which cooperates with automatic transmission switching circuits as described in the above-referenced U.S. application.

To stop the combustion engine, the ignition key is turned in a conventional manner, the magnetic valve thereby becoming deenergized. As described above, both valves thereby assume the position reference numeral II. Accordingly, the pressure medium stored in the pressure reservoir 47 can flow into the passage 21 by means of the magnetic valve 43 to thereby lengthen the distance between the joints 5 and 8 and turn the positioning lever 3 to the stop position whereby the fuel to the engine is cut off.

As described above, in order to prevent the engine from picking up speed during idling, subsequent to the positioning lever 3 being brought to a stop position due to a drop in the supply pressure in the conduit 33, the non-return valve is provided which prevents a flow of hydraulic fluid from the passage 21 into the supply conduit 33 — the passage 21 only being capable of discharging when the magnetic valve 43 is energized to its position I so that the fluid may pass into the reservoir 46.

It will be understood that each of the elements described above, or two or more together, may also find a useful application in other types of fuel control apparatus differing from the types described above.

While the invention has been illustrated and described as embodied in a hydraulic cylinder placed in the fuel system linkages to modify the speed of an engine prior to changing gears of a transmission, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In an internal combustion engine, a combination comprising a fuel-dosing arrangement comprised of a movable fuel-dosing control member movable through a plurality of positions to vary the amount of fuel entering the cylinders of the engine per combustion cycle; a footcontrolled gas pedal member; elongated linkage means connected between said gas pedal member and said control member for transmitting force from said gas pedal member to said control member in direction substantially longitudinally of said elongated linkage means in order to position said fuel-dosing control member in dependence upon the extent to which said foot-controlled gas pedal member is depressed by the foot of a driver, said linkage means comprising a double-acting hydraulic cylinder-and-piston unit comprised of a cylinder and of a piston in said cylinder dividing the interior of said cylinder into two cylinder chambers, said cylinder and piston being slidable relative to each other substantially in the direction of elongation of said elongated linkage means, with one of said members being connected to said cylinder and the other of said members being connected to said piston, and wherein said cylinder has a first fluid port communicating with the first of the cylinder chambers and a second fluid port communicating with the second of the cylinder chambers; and length-varying means for effecting movements of said fuel-dosing control member independently of movement of said gas pedal member by effecting changes in the length of said linkage means, and comprising a source of pressurized fluid, a tank, and valve means connecting said first and second fluid ports of said cylinder to said source of pressurized fluid and to said tank and operative for changing the length of said elongated linkage means by causing hydraulic fluid to flow into and out of said cylinder chambers to effect relative movement between said cylinder and said piston.

2. In an internal combustion engine, in combination, a fuel-dosing arrangement comprised of a movable fuel-dosing control member movable to a plurality of positions to vary the amount of fuel entering the cylinders of the engine per combustion cycle; a foot-controlled gas pedal mechanically linked to said fuel-dosing control member for positioning said fuel-dosing control member in dependence upon the extent to which said gas pedal is depressed by the foot of a driver; elongated linkage means connected between said gas pedal and said control member for transmitting force from said gas pedal to said control member in direction substantially longitudinally of said elongated linkage means, and including a double-acting hydraulic cylinder means having opposite ends and piston means reciprocable in said cylinder means; and length-varying means for effecting movements of said control member independently of movement of said gas pedal by effecting changes in the length of said linkage means, and comprising electromagnetically activatable two position control valves in fluid communication with said opposite ends of said cylinder means, and fluid pressure generating means connected to each of said control valves, whereby fluid pressure can be selectively applied to said piston means to force the same to move to either end of said cylinder means.

3. The combination defined in claim 1, wherein said cylinder-and-piston unit is further comprised of two oppositely acting compression springs exerting upon said piston oppositely directed biasing forces tending to maintain said piston in a centered position relative to said cylinder.

4. The combination defined in claim 1, wherein said cylinder is connected to said fuel-dosing control member and wherein said cylinder-and-piston unit is further comprised of a piston rod connected to said piston at one end of said piston rod and connected at the other end thereof to said gas pedal member.

5. In an internal combustion engine, a combination comprising a fuel-dosing arrangement comprised of a movable fuel-dosing control member movable through a plurality of positions to vary the amount of fuel entering the cylinders of the engine per combustion cycle; a foot-controlled gas pedal member; elongated linkage means connected between said gas pedal member and said control member for transmitting force from said gas pedal member to said control member in direction substantially longitudinally of said elongated linkage means in order to position said fuel-dosing control member in dependence upon the extent to which said foot-controlled gas pedal member is depressed by the foot of a driver, said linkage means comprising a double-acting hydraulic cylinder-and-piston unit comprised of a cylinder and of a piston in said cylinder dividing the interior of said cylinder into two cylinder chambers, said cylinder and piston being slidable relative to each other substantially in the direction of elongation of said elongated linkage means, with one of said members being connected to said cylinder and the other of said members being connected to said piston, and wherein said cylinder has a first fluid port communicating with the first of the cylinder chambers and a second fluid port communicating with the second of the cylinder chambers; and length-varying means for effecting movements of said fuel-dosing control member independently of movement of said gas pedal member by effecting changes in the length of said linkage means, and comprising a source of pressurized fluid, a tank, and valve means connecting said first and second fluid ports of said cylinder to said source of pressurized fluid and to said tank and operative for changing the length of said elongated linkage means by causing hydraulic fluid to flow into and out of said cylinder chambers to effect relative movement between said cylinder and said piston, wherein said valve means comprise a first electromagnetically activatable three-port two-position valve and a second electromagnetically activatable three-port two-position valve, said first and second valves each having a first port connected to said source of pressurized fluid, a second port connected to said tank and a third port connected to a respective one of the two fluid ports of said cylinder for controlling the flow of fluid into and out of the respective cylinder chamber, wherein said length-varying means further comprises a check valve connected between the first port of one of said valves and said source of pressurized fluid with a direction such as to permit the passage of fluid from said source to said first port of said one of said valves through said check valve.

6. The combination defined in claim 5, wherein said length-varying means further includes a second source of pressurized fluid also connected to the respective first ports of said three-port two-position valves.

7. In an internal combustion engine, a combination comprising a fuel-dosing arrangement comprised of a movable fuel-dosing control member movable through a plurality of positions to vary the amount of fuel entering the cylinders of the engine per combustion cycle; a foot-controlled gas pedal member; elongated linkage means connected between said gas pedal member and said control member for transmitting force from said gas pedal member to said control member in direction substantially longitudinally of said elongated linkage means in order to position said fuel-dosing control member in dependence upon the extent to which said foot-controlled gas pedal member is depressed by the foot of a driver, said linkage means comprising a double-acting hydraulic cylinder-and-piston unit comprised of a cylinder and of a piston in said cylinder dividing the interior of said cylinder into two cylinder chambers, said cylinder and piston being slidable relative to each other substantially in the direction of elongation of said elongated linkage means, with one of said members being connected to said cylinder and the other of said members being connected to said piston, and wherein said cylinder has a first fluid port communicating with the first of the cylinder chambers and a second fluid port communicating with the second of the cylinder chambers; and length-varying means for effecting movements of said fuel-dosing control member independently of movement of said gas pedal member by effecting changes in the length of said linkage means, and comprising a source of pressurized fluid, a tank, and valve means connecting said first and second fluid ports of said cylinder to said source of pressurized fluid and to said tank and operative for changing the length of said elongated linkage means by causing hydraulic fluid to flow into and out of said cylinder chambers to effect relative movement between said cylinder and said piston, wherein said valve means comprise a first electromagnetically activatable three-port two-position valve and a second electromagnetically activatable three-port two-position valve, said first and second valves each having a first port connected to said source of pressurized fluid, a second port connected to said tank and a third port connected to a respective one of the two fluid ports of said cylinder for controlling the flow of fluid into and out of the respective cylinder chamber.

* * * * *